US007237595B2

(12) United States Patent
Beck et al.

(10) Patent No.: US 7,237,595 B2
(45) Date of Patent: Jul. 3, 2007

(54) CASTING MOLD

(75) Inventors: Thomas Beck, Zepernick (DE); Georg Bostanjoglo, Berlin (DE); Uwe Paul, Ratingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/977,736

(22) Filed: Oct. 28, 2004

(65) Prior Publication Data

US 2006/0032604 A1 Feb. 16, 2006

(30) Foreign Application Priority Data

Oct. 29, 2003 (EP) ..... 03024967

(51) Int. Cl.
*B22C 9/02* (2006.01)

(52) U.S. Cl. ..... 164/361; 164/369; 164/397; 164/302; 416/97 R

(58) Field of Classification Search ..... 164/361, 164/369, 397, 302, 137; 416/97 R
See application file for complete search history.

(56) References Cited

U.S. PATENT DOCUMENTS

| | | | | |
|---|---|---|---|---|
| 3,646,185 | A * | 2/1972 | Jennings | 264/161 |
| 4,565,490 | A | 1/1986 | Rice | |
| 5,465,780 | A * | 11/1995 | Muntner et al. | 164/516 |
| 5,609,779 | A * | 3/1997 | Crow et al. | 219/121.71 |
| 5,623,985 | A | 4/1997 | Wheaton et al. | |
| 5,950,705 | A | 9/1999 | Huang | |
| 6,305,903 | B1 * | 10/2001 | Semmler et al. | 416/97 R |
| 6,340,047 | B1 | 1/2002 | Frey | |
| 6,530,416 | B1 * | 3/2003 | Tiemann | 164/137 |
| 6,547,525 | B2 * | 4/2003 | Haehnle et al. | 416/97 R |
| 6,708,499 | B2 * | 3/2004 | Pidcock et al. | 60/796 |
| 6,932,571 | B2 * | 8/2005 | Cunha et al. | 416/97 R |

FOREIGN PATENT DOCUMENTS

| | | |
|---|---|---|
| DE | 27 54 231 C1 | 1/1994 |
| DE | 198 21 770 C1 | 4/1999 |
| DE | 100 53 356 A1 | 5/2002 |
| EP | 0 227 579 A2 | 7/1987 |
| EP | 0 559 251 A1 | 9/1993 |
| EP | 0 585 183 A1 | 3/1994 |

* cited by examiner

*Primary Examiner*—Kevin Kerns
*Assistant Examiner*—I.-H. Lin

(57) ABSTRACT

According to the prior art, through-holes in components are often introduced after the production (casting) of the component. This entails additional outlay in terms of time and equipment. The time required can be considerably shortened if a casting mold is designed in such a way that the through-hole is at least in part formed by corresponding projections being formed on the inner wall and/or the outer wall of the casting mold.

20 Claims, 5 Drawing Sheets

CASTING MOLD

CROSS REFERENCE TO RELATED APPLICATION

This application claims priority of the European application No. 03024967.6 EP filed Oct. 29, 2003, which is incorporated by reference herein in its entirety.

FIELD OF THE INVENTION

The invention relates to a casting mold as claimed in the claims.

BACKGROUND OF THE INVENTION

Components which are designed as hollow bodies with complex geometries and complex through-holes in the region of an outer wall of the component can be produced in various ways.

Many components, in particular metallic components made from alloys, are produced by casting processes, for example by the investment casting process. In this process, in a first step a casting mold which at least in part represents the negative of the component to be produced is produced from a wax model of the component by the wax model being encased in ceramic.

Through-holes in the walls of hollow components, such as for example film-cooling holes in turbine components, are usually introduced at a later stage by means of a laser and its laser beams, as shown by U.S. Pat. No. 6,329,015 B1. The laser beam guidance is very complex. This entails remachining of the casting or of the directionally solidified component. Consequently, processes for producing a casting with holes which are introduced at a later stage, in particular through-holes, are therefore time-consuming.

SUMMARY OF THE INVENTION

Consequently, it is an object of the invention to provide a casting mold which allows the production of a component with holes, in particular with through-holes, more easily and more quickly.

This object is achieved by a casting mold as claimed in the claims which is used to produce the casting.

The casting mold used has corresponding projections, which at least in part represent the negative of a hole.

Further advantageous measures are listed in the subclaims. The measures listed in the subclaims can be combined with one another in advantageous ways.

DETAILED DESCRIPTION OF THE INVENTION

Figure 1:
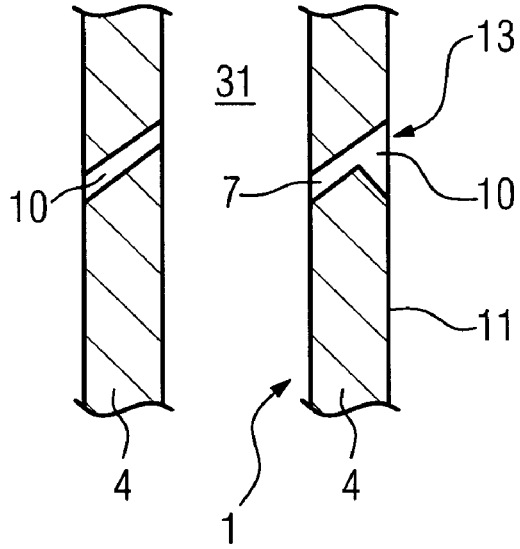
FIG. 1 shows a component with a through-hole.

FIG. 1 shows a component 1 which, by way of example, at least in part has a cavity 31 and can be produced using the casting mold according to the invention. Therefore, the component 1 has a wall 4, in particular an outer wall 4. At least one hole 13, in this case a through-hole 13, is formed in the wall 4. The component 1 may, for example, be metallic or ceramic. By way of example, it is a turbine component 1 of a gas turbine 100 (FIG. 7) or steam turbine 300, 303 (FIG. 9). This component is, for example, a turbine blade or vane 120, 130, 354, 357 (FIG. 7) or a combustion chamber lining 155 (FIG. 8), which consists, for example, of an iron-, nickel- or cobalt-base super alloy. In components 1 of this type, through-holes 13 are used, for example, to cool the component 1 by film cooling. The through-hole 13 consists, for example, of a round or oval hole part 7 which widens out from the cavity 31 to the outer surface 11 of the wall 4 to form a diffuser 10. Components 1 of this type with complex geometries of a through-hole 13, 7+10 can be produced more quickly and more easily using the process according to the invention.

The wall is in this case, by way of example, 2 to 6 mm, in particular 3 to 4 mm, thick. The hole part 7 has a diameter of from 0.3 to 1.2 mm, in particular 0.6 to 0.8 mm. The diffuser 10 is, for example, designed in the shape of a trapezium at the surface and has dimensions of 1.5 to 5 mm ×1.5 to 5 mm and enters into the wall 4 to a depth of 1 to 1.5 mm.

Figure 2:
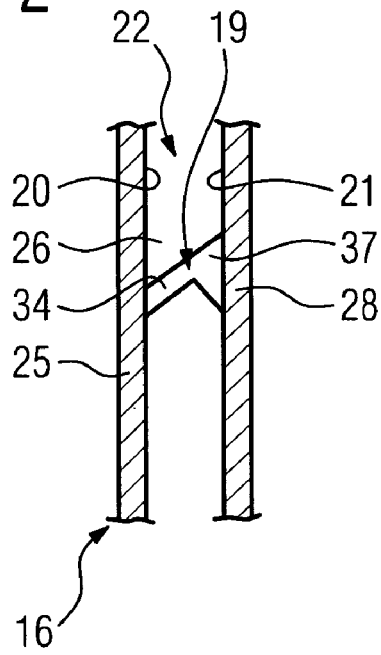
FIGS. 2, 3, 4, 5 show casting molds with various projections for forming a through-hole.

FIG. 2 diagrammatically depicts part of a casting mold 16 which comprises an inner wall 25, in particular a mold core 25 (produces for example the cavity 31 of the component 1), and an outer wall 28. Material 22 (for example metal) is cast into this space 26 (cavity of the casting mold 16) between inner wall 25 and outer wall 28, and after cooling, by way of example, forms the wall 4 of the component 1. The core 25 forms, for example, a part of the cavity 31 of the component 1.

According to the invention, at least one projection 19 is formed in this space 26. The projection 19 extends at least part way from an inner surface 20 of the inner wall 25 to an inner surface 21 of the outer wall 28. In this case, the projection 19 extends continuously from the inner surface 20 to the inner surface 21.

The projection 19 has been formed by casting ceramic material into a through-hole 13 in the wax model of the component 1 or by the insertion of suitably shaped pins, for example ceramic pins, into the walls 25, 28 of the casting mold 16. It is also possible for the through-holes 13 to be produced in the wax model of the component by means of slides or pins which are shaped so as to match the part 7 or 10 of the hole.

The projection 19 in the space 26 prevents this area from being filled with material 22 during casting, so that after the casting mold 16 with its inner wall 25 and its outer wall 28 and the projection 19 has been removed, at least in part a through-hole 13 results.

The projection 19 is, for example, of the following construction. A first projection region 34 represents the round or oval (FIG. 6) hole part 7 of the through-hole 13. A second projection region 37 represents the diffuser 10. However, the projection 19 may also be round or oval in form over its entire cross section and may also, for example, be constant in terms of its cross-sectional area.

If appropriate, it is also possible to carry out minimal remachining of the through-opening 13, but this remachining at any rates significantly reduced compared to previous processes.

Figure 3:
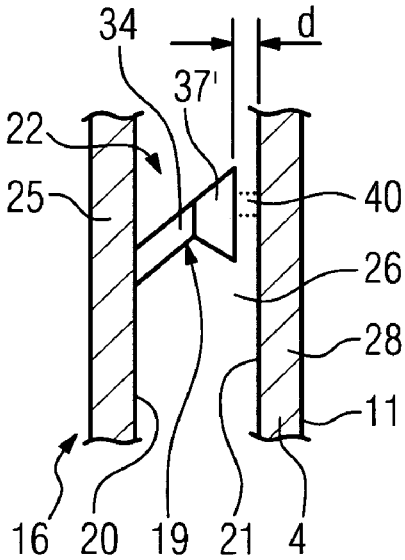

FIG. 3 shows a further exemplary embodiment of a casting mold 16 according to the invention. Unlike in the casting mold 16 shown in FIG. 2, the projection 19 does not extend continuously from an inner surface 20 of the inner wall 25 to an inner surface 21 of the outer wall 28. The projection 19 is formed only on the inner surface 20 of the inner wall 25 and extends to a certain distance d from the inner surface 21 of the outer wall 28. When the cavity 26 is filled with material 22, therefore, a complete through-opening 13 is not formed. After casting of the component 1, material 22 is present in the region between the projection 19, 34 and the inner surface 21 of the outer wall 28. However, this region is correspondingly thin, in particular membrane-like in form, so that it can easily be removed within a very short time. It could also be said that the through-opening 13 in the component 1 to be produced is still closed to some extent. This is expedient, for example, if at least one coating is subsequently to be applied to the outer surface 11 of the component 1. Since the through-opening 13 is still closed, the through-opening 13 is also not contaminated or narrowed by material of the coating. The material of the coating, which is thin compared to the thickness of the wall 4, and the small amount of material 22 which is still closing off the through-opening 13, is removed quickly and easily only after the final treatment step. The coating is, for example, an MCrAlX alloy (M=Fe, Co, Ni and X=Y and/or a rare earth element) and if appropriate a ceramic coating as thermal barrier coating (for example $Y_2O_3$—$ZrO_2$).

The projection 19 may also have a supporting connection 40 (indicated by dashed lines) for supporting the projection 19, which protrudes freely into the space 26, on the outer wall 28. The cross section of the supporting connection 40 is designed to be smaller than the cross section of the projection 19 lying opposite the outer wall 28. The supporting connection 40 therefore represents only part of the through-hole 13 which is to be produced. In this example, the projection 19 in turn has two regions 34, 37'. In particular the complex geometry of the diffuser is complex to remachine. This remachining is in this case mostly eliminated, since only a relatively small upper region of the diffuser 10 has to be remachined by removal of material. Since in particular the regions lying lower down in the wall 4 entail significant outlay in, for example, laser guidance, this casting mold has considerable advantages.

Figure 4:
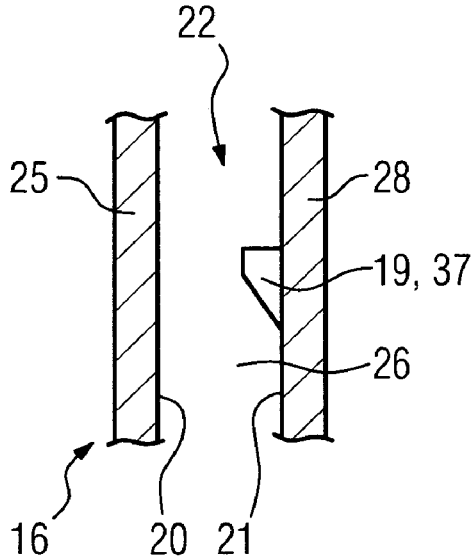

FIG. 4 shows a further exemplary embodiment of a casting mold 16 designed in accordance with the invention. In this case, the projection 19 is formed only on the inner surface 21 of the outer wall 28. The projection 19 represents the negative 37 of the diffuser 10 of the through-opening 13 which is to be produced. In particular the diffuser 10 has a more complex geometry than a simple symmetrical hole and could therefore only be produced with great difficulty by being machined in retrospectively. However, if the diffuser region 10 has already been formed in the surface of the component 1 to be produced, it no longer needs to be remachined. It is merely necessary to machine a hole 7 of simple design (FIG. 1) from the diffuser region 10 into the wall 4 of the component 1, which entails only a relatively low level of outlay. This can be achieved by laser machining or wire EDM and also by means of other processes.

In this case too, there may be a corresponding supporting connection 40 between the projection 19, 37 and the inner wall 25.

Figure 5:
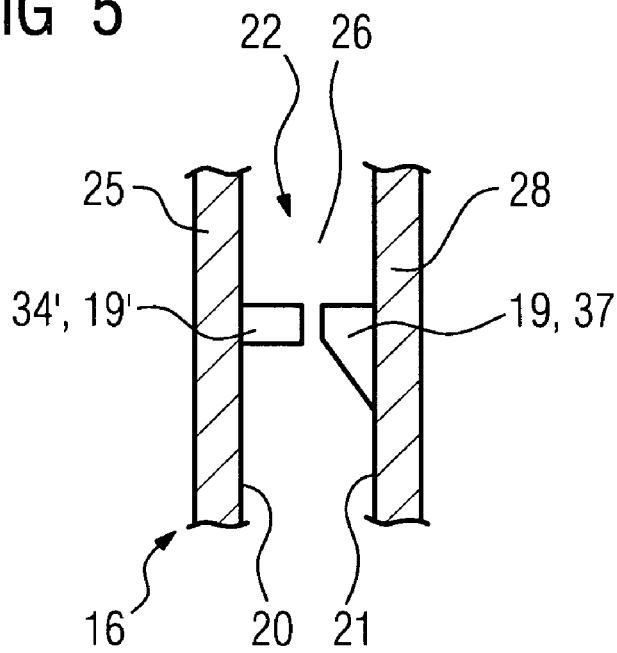

FIG. 5 shows a further exemplary embodiment of a casting mold 16 designed in accordance with the invention. Proceeding from FIG. 4, a second projection 19' is also formed on the inner surface 20 of the inner wall 25. The projection 19', 34' forms a further part of this through-opening 13, namely the region of the hole part 7. The projection 19, 37 represents the region of the diffuser 10 of the component 1 that is to be produced. The projection 19' shortens the machining time for producing the hole 7 in the component 1 that is to be produced compared to a component 1 which has been produced using a casting mold as shown in FIG. 4. In particular, casting molds 16 in which there is not a continuous connection between inner wall 25 and outer wall 28 are simple to produce, since the core 25 can be produced separately from the wall 28 and is introduced into the casting mold 16 for casting. The projections 19, 19' may bear against one another or may be at a certain distance from one another.

Figure 6:
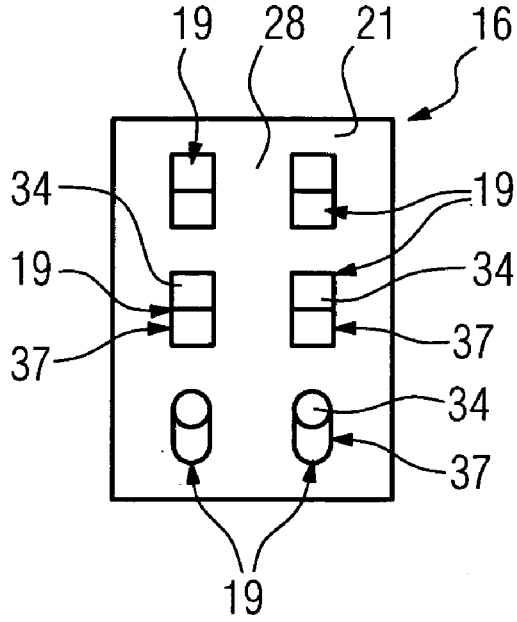
FIG. 6 shows a view of an inner surface of a casting mold.

FIG. 6 shows a view of an outer wall 28 of a casting mold 16 which is designed in accordance with the invention. A plurality of projections 19 are formed on the inner surface 21 of the outer wall 28. Reference numeral 34 denotes the region from which the formation of the hole 7 starts. Reference numeral 37 denotes the region of the projection 19 which forms the diffuser region 10 of the through-hole 13 that is to be produced.

Figure 7:
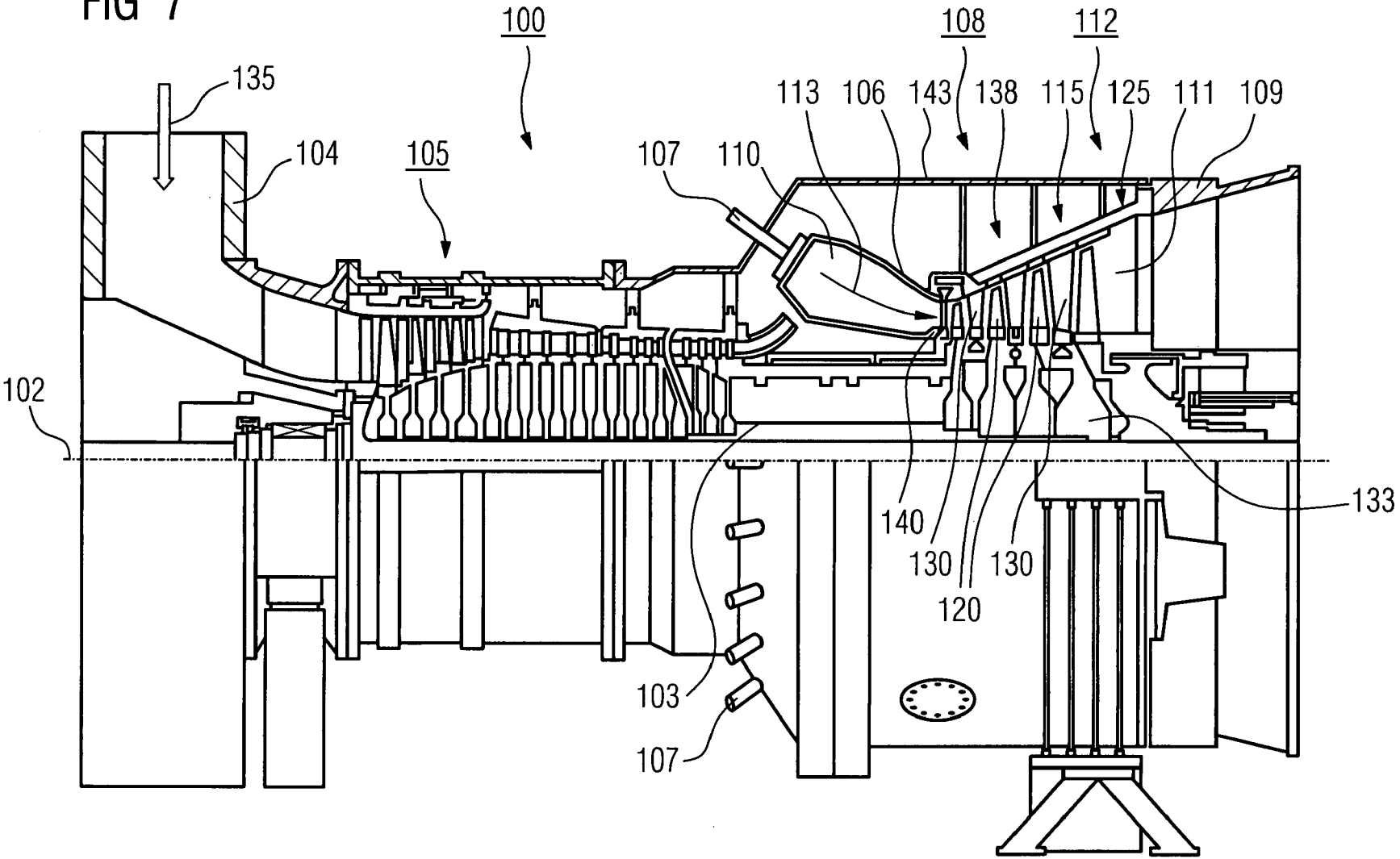
FIG. 7 shows a gas turbine.

FIG. 7 shows, by way of example, a longitudinal section through part of a gas turbine 100. In the interior, the gas turbine 100 has a rotor 103 which is mounted such that it can rotate about an axis of rotation 102. An intake housing 104, a compressor 105, a, for example, toroidal combustion chamber 110, in particular an annular combustion chamber 106, with a plurality of coaxially arranged burners 107, a turbine 108 and the exhaust-gas housing 109 follow one another along the rotor 103. The annular combustion chamber 106 is in communication with an, for example, annular hot-gas duct 111. There, by way of example, four series-connected turbine stages 112 form the turbine 108. Each turbine stage 112 is formed from two rings of blades or vanes. As seen in the direction of flow of a working medium 113, a row 125 formed from rotor blades 120 follows a row 115 of guide vanes in the hot-gas duct 111.

The guide vanes 130 are secured to the stator 143, whereas the rotor blades 120 of a row 125 are mounted on the rotor 103 by means of a turbine disk 133. A generator or working machine (not shown) is coupled to the rotor 103.

While the gas turbine 100 is operating, the compressor 105 sucks in air 135 through the intake housing 104 and compresses this air. The compressed air provided at the turbine-side end of the compressor 105 is fed to the burners 107, where it is mixed with a fuel. The mixture is then burnt so as to form the working medium 113 in the combustion chamber 110. From there, the working medium 113 flows along the hot-gas duct 111 past the guide vanes 130 and the rotor blades 120. The working medium 113 expands at the rotor blades 120, transferring its momentum, so that the rotor blades 120 drive the rotor 103 and the latter drives the working machine coupled to it.

While the gas turbine 100 is operating, the components which are exposed to the hot working medium 113 are subject to thermal loads. The guide vanes 130 and rotor blades 120 of the first turbine stage 112, as seen in the direction of flow of the working medium 113, and also the heat shield bricks which line the annular combustion chamber 106, are subject to the highest thermal loads. To enable them to withstand the temperatures prevailing there, they are cooled by means of a coolant. It is also possible for the blades and vanes 120, 130 to have coatings to protect against corrosion (MCrAlX; M=Fe, Co, Ni, X=Y, rare earths) and heat (thermal barrier coating, for example $ZrO_2$, $Y_2O_4$—$ZrO_2$). The turbine blade or vane 120, 130 is often also air-cooled and has film-cooling holes 13 which are produced in the cast and/or directionally solidified turbine blade 120, 130 using the casting mold 16 according to the invention (FIG. 2).

The guide vane 130 has a guide vane root (not shown here) facing the inner housing 138 of the turbine 108 and a guide vane head on the opposite side from the guide vane root. The guide vane head faces the rotor 103 and is fixed to a securing ring 140 of the stator 143.

Figure 8:
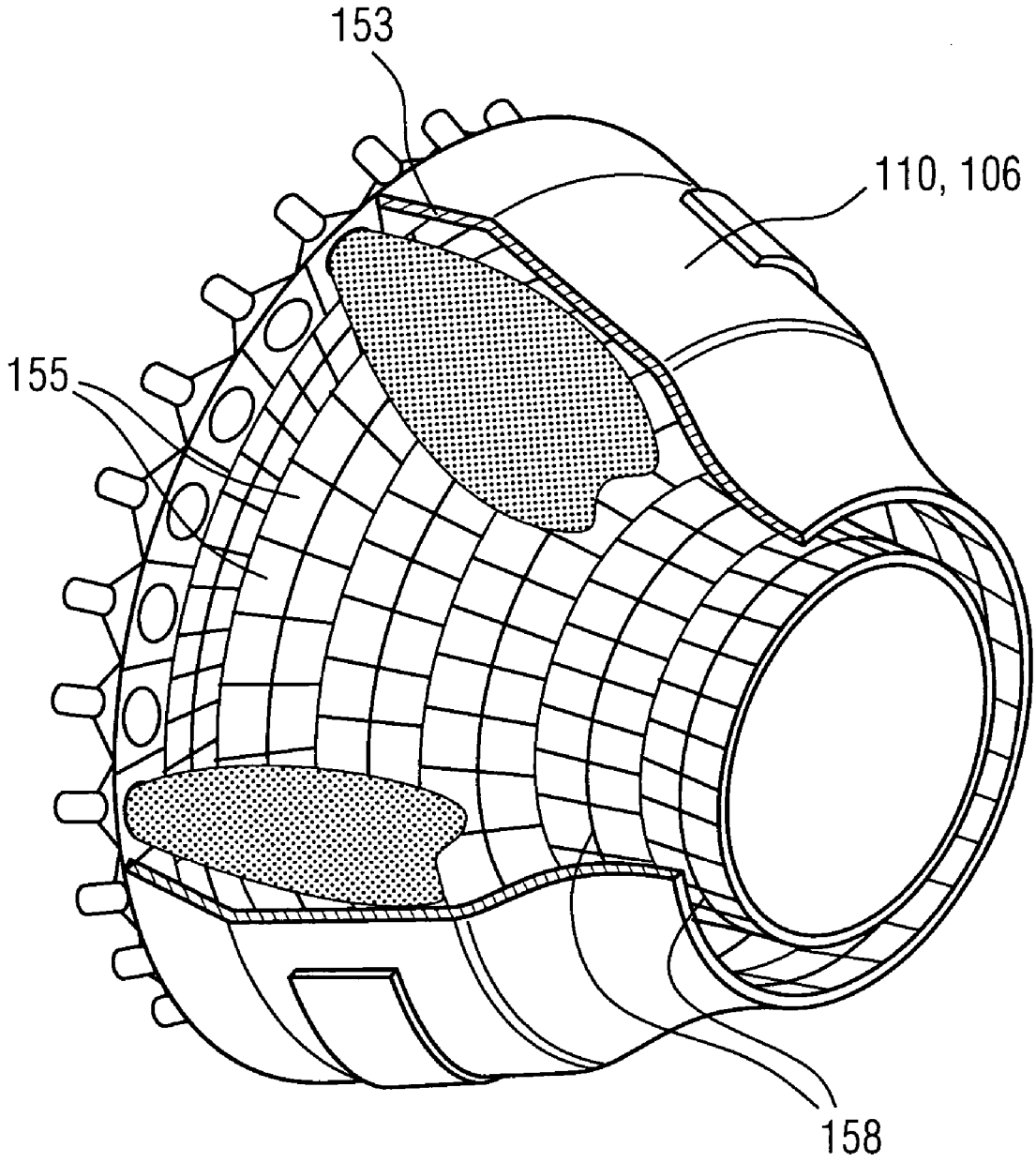
FIG. 8 shows a combustion chamber.
Figure 9:
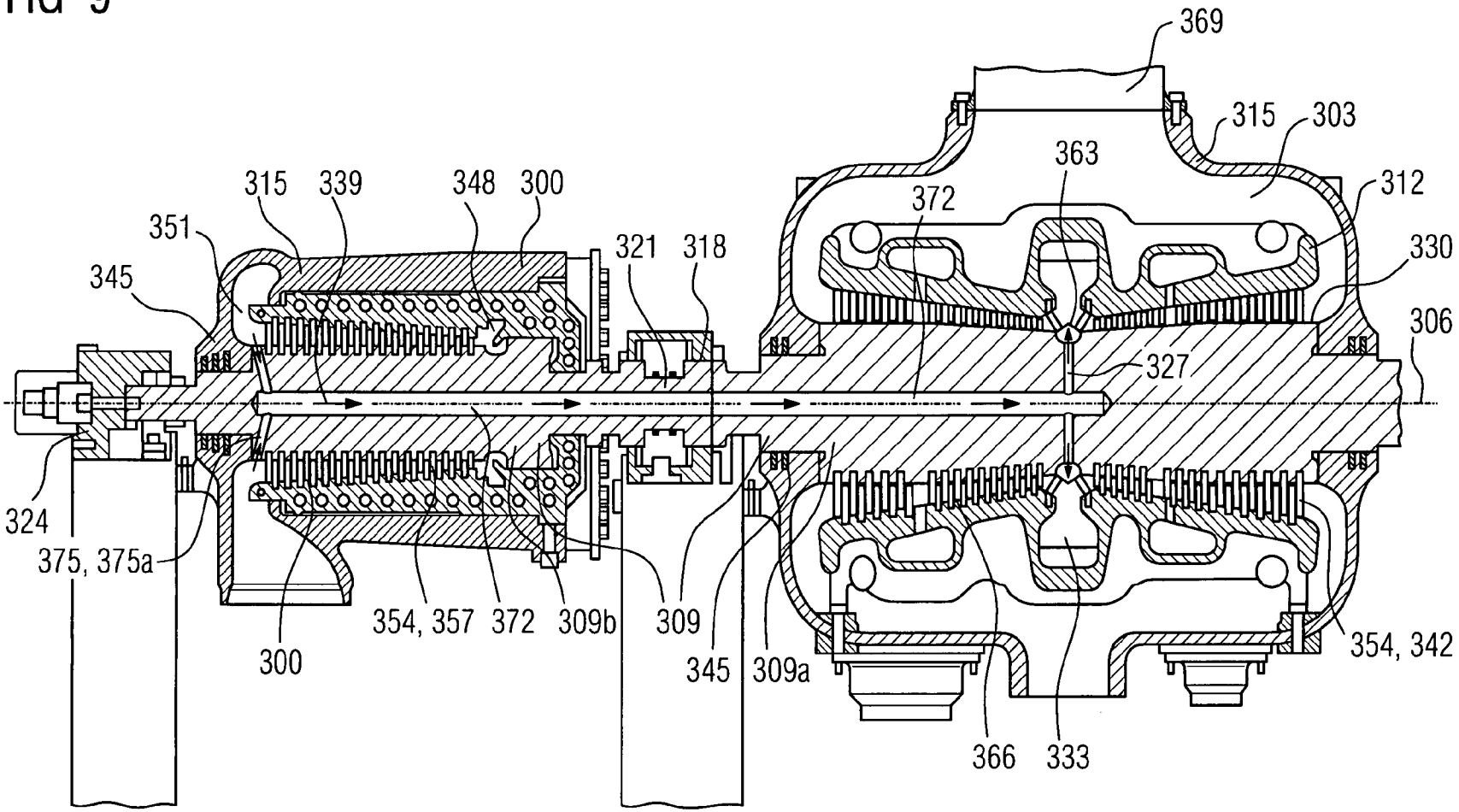
FIG. 9 shows a steam turbine.

FIG. 8 shows a combustion chamber 110 of a gas turbine. The combustion chamber 110 is designed, for example, as what is known as an annular combustion chamber, in which a multiplicity of burners 102, which are arranged around the turbine shaft 103 in the circumferential direction, open out into a common combustion chamber space. For this purpose, the overall combustion chamber 110 is designed as an annular structure which is positioned around the turbine shaft 103.

To achieve a relatively high efficiency, the combustion chamber 110 is designed for a relatively high temperature of the working medium M of approximately 1000° C. to 1600° C. To allow a relatively long operating time even at these operating parameters, which are unfavorable for the materials, the combustion chamber wall 153 is provided, on its side which faces the working medium M, with an inner lining formed from heat shield elements 155. On the working medium side, each heat shield element 155 is equipped with a particularly heat-resistant protective layer or is made from material which is able to withstand high temperatures. Moreover, on account of the high temperatures in the interior of the combustion chamber 110, a cooling system is provided for the heat shield elements 155 and/or for their holding elements. The heat shield elements 155 often have film-cooling holes 13 or passages for fuel to pass into the combustion chamber 110, and these are produced in the heat shield element 155 using the casting mold 16 according to the invention.

The combustion chamber 110 is designed in particular to detect losses in the heat shield elements 155. For this purpose, a number of temperature sensors 158 are positioned between the combustion chamber wall 153 and the heat shield elements 155.

FIG. 9 illustrates, by way of example, a steam turbine 300, 303 with a turbine shaft 309 extending along an axis of rotation 306. The steam turbine has a high-pressure part-turbine 300 and a medium-pressure part-turbine 303, each with an inner housing 312 and an outer housing 315 surrounding the latter. The high-pressure part-turbine 300 is, for example, designed in pot form. The medium-pressure part-turbine 303 is of double-flow design. It is also possible for the medium-pressure part-turbine 303 to be of single-flow design. Along the axis of rotation 306, a bearing 318 is arranged between the high-pressure part-turbine 300 and the medium-pressure part-turbine 303, the turbine shaft 309 having a bearing region 321 in the bearing 318. The turbine shaft 309 is mounted on a further bearing 324 next to the high-pressure part-turbine 300. In the region of this bearing 324, the high-pressure part-turbine 300 has a shaft seal 345. The turbine shaft 309 is sealed off with respect to the outer housing 315 of the medium-pressure part-turbine 303 by two further shaft seals 345. Between a high-pressure steam inlet region 348 and a steam outlet region 351, the turbine shaft 309 in the high-pressure part-turbine 300 has the high-pressure rotor blading 354, 357. This high-pressure rotor blading 354, 357, together with the associated rotor blades (not shown in more detail), constitutes a first blading region 360. The medium-pressure part-turbine 303 has a central steam inlet region 333. Assigned to the steam inlet region 333, the turbine shaft 309 has a radially symmetrical shaft shield 363, a covering plate, on the one hand for dividing the flow of steam into the two flows of the medium-pressure part-turbine 303, and also for preventing direct contact between the hot steam and the turbine shaft 309. In the medium-pressure part-turbine 303, the turbine shaft 309 has a second blading region 366 comprising the medium-pressure rotor blades 354, 342. The hot steam flowing through the second blading region 366 flows out of the medium-pressure part-turbine 303 from an outlet stub 369 to a low-pressure part-turbine, which is not shown but is downstream in terms of flow.

The turbine shaft 309 is composed of two partial turbine shafts 309*a* and 309*b*, which are fixedly connected to one another in the region of the bearing 318. Each partial turbine shaft 309*a*, 309*b* has a cooling line 372 formed as a central bore 372*a* along the axis of rotation 306. The cooling line 372 is connected to the steam outlet region 351 via inflow line 375, which has a radial bore 375*a*. In the medium-pressure part-turbine 303, the coolant line 372 is connected to a cavity (not shown in more detail) beneath the shaft shield 363. The inflow lines 375 are designed as radial bores 375*a*, with the result that "cold" steam from the high-pressure part-turbine 300 can flow into the central bore 372*a*. Via the outlet line 372, which is in particular also designed as a radially oriented bore 375*a*, the steam passes through the bearing region 321 into the medium-pressure part-turbine 303, where it then passes onto the lateral surface 330 of the turbine shaft 309 in the steam inlet region 333. The steam flowing through the cooling line is at a significantly lower temperature than the reheated steam flowing into the steam inlet region 333, so that effective cooling of the first rotor blade rows 342 of the medium-pressure part-turbine 303 and of the lateral surface 330 in the region of these rotor blade rows 342 is ensured.

The invention claimed is:

1. A mold for producing a cast turbine component, comprising:

a mold outer wall having an inner surface;

a mold inner wall having an inner surface;

a component outer wall formed by the region between the mold outer wall and the mold inner wall; and a projection extending from the inner surface of the inner wall toward the inner surface of the outer wall that forms a portion of a shaped hole having a diffuser portion in the component outer wall.

2. The mold as claimed in claim 1, wherein the projection produces a through-hole in the cast component.

3. The mold as claimed in claim 2, wherein the through-hole has a diameter between 0.6 to 0.8 mm.

4. The mold as claimed in claim 1, wherein the projection extends from the inner surface of the outer wall toward the inner surface of the inner wall.

5. The mold as claimed in claim 1, wherein the component is a turbine blade, turbine vane, or a combustion chamber liner.

6. The casting mold as claimed in claim 1, wherein the casting mold is used to produce a turbine component of a gas turbine or steam turbine.

7. The casting mold as claimed in claim 6, wherein the turbine component is a turbine blade or vane.

8. The casting mold as claimed in claim 6, wherein the turbine component is a combustion chamber lining.

9. The mold as claimed in claim 1, wherein the diffuser portion of the shaped hole is trapezoidal in shape.

10. The mold as claimed in claim 9, wherein the trapezoidal shape at the outer wall of the cast turbine component has a base of 1.5 mm to 5 mm and a height of 1.5 mm to 5 mm and extends into the outer wall a depth of 1 mm to 1.5 mm.

11. A casting mold for producing a turbine component, comprising:

a projection located on an interior of the mold; and a shaped hole having a diffuser portion that is produced by the projection located in an outer wall of the cast turbine component.

12. The casting mold as claimed in claim 11, wherein the casting mold has an inner wall and an outer wall and the projection extends between the inner wall and the outer wall.

13. The casting mold as claimed in claim 12, wherein the projection extends part way between the inner wall and the outer wall.

14. The casting mold as claimed in claim 13, wherein the projection is formed only on the inner wall.

15. The casting mold as claimed in claim 14, wherein the projection is connected to the opposite wall by a supporting connection and the supporting connection represents only part of the cross section of the through-opening.

16. The casting mold as claimed in claim 13, wherein the projection is formed only on the outer wall.

17. The casting mold as claimed in claim 13, wherein a projection is formed on the inner wall and a further projection is formed opposite the projection on the outer wall, and result in a through-hole.

18. The casting mold as claimed in claim 11, wherein a component having a through-hole with a geometry that differs from a circular or oval shape is produced.

19. The casting mold as claimed in claim 18, wherein the through-hole forms a film-cooling hole which having a diffuser that is formed by a corresponding projection on an outer wall of the casting mold.

20. The mold as claimed in claim 11, where the diffuser is divergent.

* * * * *